United States Patent [19]

Frank

[11] 4,156,499

[45] May 29, 1979

[54] MAGAZINE LATCHING ASSEMBLY FOR A COMPACT TACKER

[75] Inventor: Edmund Frank, Chicago, Ill.

[73] Assignee: Duo-Fast Corporation, Franklin Park, Ill.

[21] Appl. No.: 843,593

[22] Filed: Oct. 19, 1977

[51] Int. Cl.[2] ..... B25C 5/10

[52] U.S. Cl. ..... 227/132

[58] Field of Search ..... 227/132, 122

[56] References Cited

U.S. PATENT DOCUMENTS

| | | | |
|---|---|---|---|
| 2,112,941 | 4/1938 | Weber et al. | 227/122 |
| 2,617,096 | 11/1952 | Boroughs | 227/122 X |
| 2,719,296 | 10/1955 | Marano | 227/122 X |
| 2,733,440 | 2/1956 | Jenny | 227/122 X |
| 3,840,165 | 10/1974 | Howard | 227/122 X |

*Primary Examiner*—Roy Lake

*Assistant Examiner*—Paul A. Bell

*Attorney, Agent, or Firm*—Mason, Kolehmainen, Rathburn & Wyss

[57] ABSTRACT

A compact tacker for driving fasteners into a workpiece includes a housing defining a handle and a nose portion. A driver is reciprocally mounted within a drive track defined within the nose portion. The tacker also includes a magazine assembly slideably mounted within the housing including a forward end that is positioned adjacent the drive track such that the driver reciprocates between the nose and the forward end of the magazine assembly. A bistable biasing member is mounted within the housing and in a first stable position, biases the magazine toward the nose and in a second stable position biases the magazine assembly away from the nose. In the second position there is defined an open area around the drive track to allow removal of jammed fasteners.

16 Claims, 6 Drawing Figures

FIG. 3
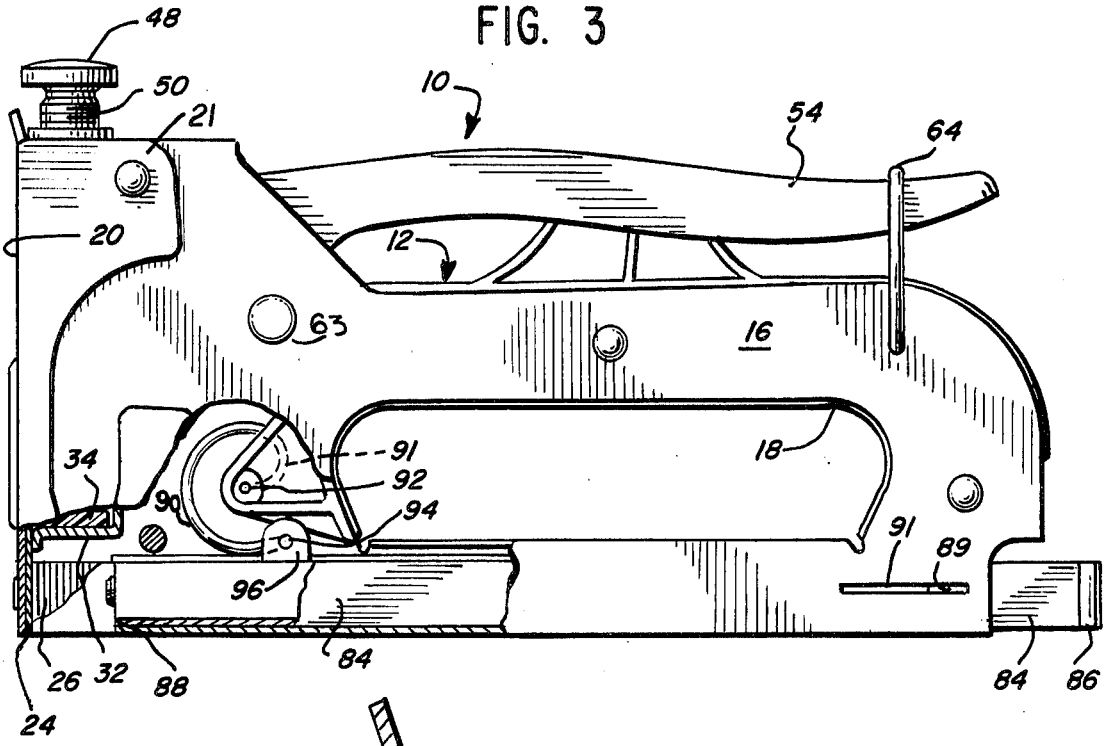
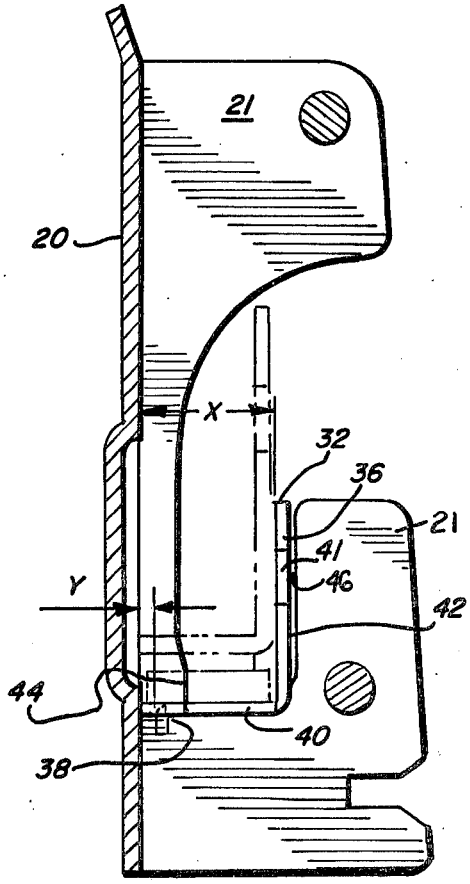
FIG. 4

MAGAZINE LATCHING ASSEMBLY FOR A COMPACT TACKER

BACKGROUND OF THE INVENTION

A. Field of the Invention

The present invention relates to a new and improved compact tacker for driving fasteners into a workpiece and to a latching device for latching a magazine assembly of the tacker in either a first, fastener driving position or in a second drive track clearing position.

B. Description of the Prior Art

A convenient tool for fastening articles is a hand held tacker device that may be employed to drive fasteners such as staples into a workpiece. Typical prior art tackers include a magazine that feeds a stick of fasteners such as staples into a drive track whereupon the fastener is driven by a driver blade into the workpiece.

The drive track within which the driver is reciprocated requires close tolerances in order to insure smooth and complete reciprocation of the driver. The driver is normally secured to a plunger that is mounted within a plunger guide in the nose portion of the driver. Prior art plunger guides normally include several parts defining the guide or track within which the plunger is reciprocated. Due to the close tolerances necessary, the multiple parts of the plunger guide including several plates in the prior art tackers require sophisticated manufacturing techniques in order to maintain the necessary tolerances.

During the operation of prior art tackers, it occurs on occasion that one of the fasteners is deformed or for some other reason is jammed within the drive track preventing operation of the tacker. This jammed fastener must be cleared from the drive track before the tacker may be continued to be used.

Several procedures have been employed in the past for clearing the track. Some prior art tackers include a nose portion pivotally attached to the body of the tacker. Upon release of a holding mechanism the nose portion may be pivoted away from the drive track allowing the staples to be removed. Other prior art tackers include a pivotally mounted magazine assembly that may be pivoted downward away from the tacker body allowing removal of the jammed fasteners.

The pivotally mounted nose or magazine assemblies in prior art tackers often times require multiple structural members to insure the securement of the pivotal portion to the housing during normal operation. In addition, the pivotal movement of the nose or the magazine from the tacker housing often is not sufficient to allow the insertion of a tool or a finger to remove the jammed staples requiring disassembly of the tacker in order to remove the jammed fasteners.

SUMMARY OF THE INVENTION

An object of the present invention is to provide a new and improved compact tacker for driving fasteners into a workpiece.

Another object of the present invention is to provide a new and improved compact tacker that includes a one-piece plunger guide thus reducing the manufacturing operations necessary to insure that these parts of the tacker are of the necessary tolerances.

Another object of the present invention is to provide a new and improved tacker that includes a fastener magazine slideably mounted in the housing of the tacker and a bistable biasing device for maintaining the magazine in the operative position in a first stable position and maintaining the magazine in a clearing position in a second stable position allowing clearance of jammed staples in the drive track.

Briefly, the present invention is directed to a new and improved compact tacker for driving fasteners into a workpiece. The tacker includes a housing having a nose portion and a handle portion adapted to be gripped by the operator. The nose portion includes a one-piece plunger and driver blade guide within which a plunger is reciprocated under the influence of a spring. A driver blade is connected to the plunger and is reciprocated by the plunger within a drive track defined within the nose portion.

The tacker also includes a magazine assembly slideably mounted within the housing having a forward end positioned, in the operative position, adjacent the nose portion to define the drive track. The magazine assembly may be moved to a second, extended position away from the nose portion allowing access to the drive track to remove jammed staples therein.

To maintain the magazine assembly in the first and second positions, a bistable biasing member is mounted within the housing. The bistable member includes a first stable position biasing the magazine assembly into its operative position and a second stable position biasing the magazine assembly to the clearing position allowing access to the drive track allowing removal of staples.

BRIEF DESCRIPTION OF THE DRAWINGS

The above and other objects and advantages and novel features of the present invention will become apparent from the following detailed description of the preferred embodiment of the invention illustrated in the accompanying drawings wherein:

FIG. 3 is a view with the magazine of the tacker moved to a position away from the drive track;

FIG. 4 is an enlarged side view of the nose of the tacker of the present invention;

DETAILED DESCRIPTION OF A PREFERRED EMBODIMENT

Figure 1:
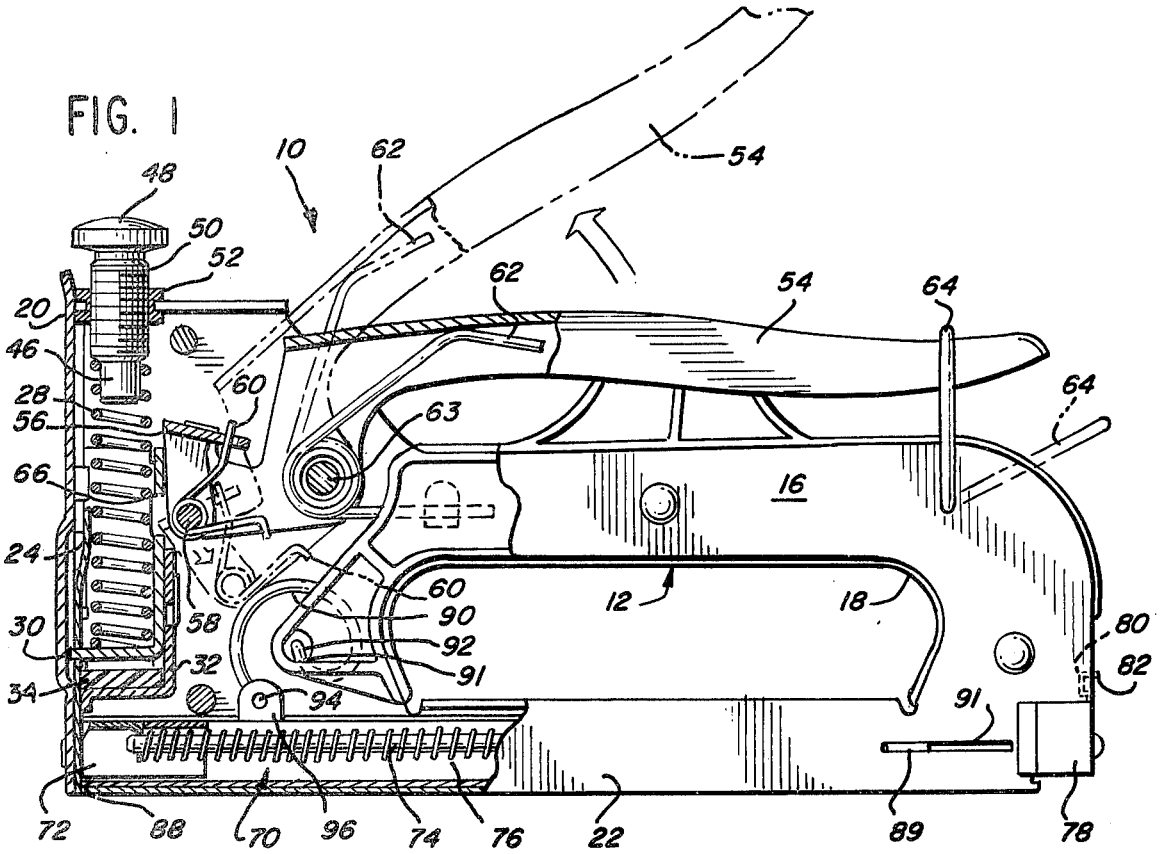
FIG. 1 is a partially cut away view of a tacker constructed in accordance with the principles of the present invention.
Figure 2:
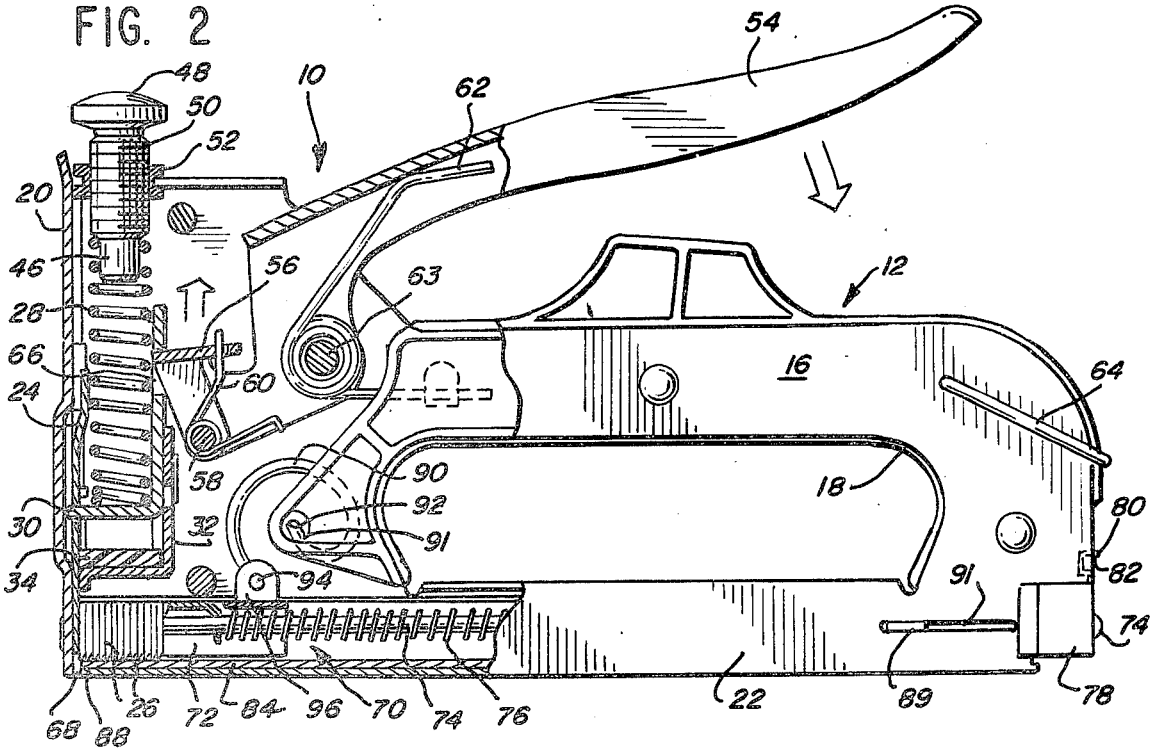
FIG. 2 is a view similar to FIG. 1 with the tacker in an actuated position.

Having reference to the figures and initially to FIGS. 1–3, there is illustrated a hand-held compact tacker generally designated by the reference numeral 10. The compact tacker 10 is of the type that may be operated by hand and employed to drive fasteners such as staples into a workpiece. One example of the use of the tacker 10 is to upholster furniture.

The tacker 10 includes a frame or body generally designated by the reference numeral 12 that defines a grip portion 16. Grip portion 16 includes an aperture 18 such that the fingers of the user may extend through the frame 12 from one side to the other, allowing the tacker 10 to be held. Defined at the forward end of the tacker 10 is a nose 20 that includes a pair of flanges 21 (FIG. 4) that are secured to the frame 12. At the lower portion of the frame 12 there is defined a channel 22 that is of an inverted U-shape with an open bottom that carries a fastener magazine. In order to drive fasteners there is included within the nose portion 20 a driver blade 24. Fasteners such as the staples designated by the reference numeral 26 are positioned within the channel 22 and the driver 24 is reciprocated within the nose portion 20, thus driving the fasteners 26 into a workpiece.

More specifically, the driver 24 is elevated within the nose portion 20 against the bias of a drive spring 28. This action compresses the drive spring 28 storing energy. The driver 24 is then released and powered under the influence of the spring 28 to drive a staple 26 into a workpiece.

The driver 24 is secured to a plunger 30 that is reciprocally mounted within a plunger guide 32 and the guide 32 is secured within the nose portion 20. To drive the driver 24 through a power stroke, the plunger 30 is elevated within the plunger guide 32 compressing the spring 28. Once the desired amount of energy has been stored within the spring 28, the plunger 30 is released moving the plunger 30 downward within the plunger guide 32 under the influence of the spring.

To prevent destruction of the plunger 30 and the plunger guide 32 upon impact of the plunger 30 and the guide 32 at the lowest most point of its driving stroke, a bumper 34 fabricated from a resilient material is mounted within the bottom portion of the plunger guide 32. Accordingly, at the lower point of the drive stroke, the plunger 30 engages the bumper 34 that absorbs some of the energy thus protecting the plunger 30 and plunger guide 32.

Figure 5:
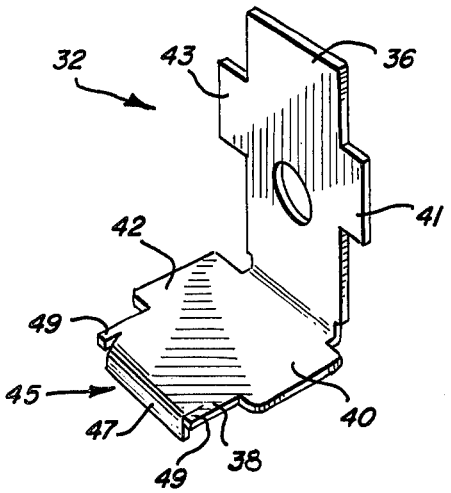
FIG. 5 is a perspective view of the plunger guide of the tacker of the present invention.

Considering briefly the plunger guide 32 and the plunger 30, reference is made to FIGS. 4 and 5. Typically in prior art tackers of the type illustrated in FIGS. 1–3 the plunger guide 32 is subject to close tolerances such that the plunger 30 smoothly reciprocates within the plunger guide 32 without any interference inhibiting the movement or reciprocation of the plunger 30 and the driver 24. This necessity for close tolerances is accomplished in the prior art through the employment of several plates defining a plunger guide. Each plate is closely machined to meet the necessary tolerance requirements.

The tacker 10 of the present invention, however, includes the plunger guide 32 that is a single piece and of an L-shape configuration including a first, long leg 36 and a second shorter leg 38. On the short leg 38 there are included two flanges or lugs 40 and 42 extending transversely to the leg 38. These flanges 40 and 42 are inserted within a pair of slots 44 defined within the flanges 21 of the nose portion 20. In addition, each flange 21 includes a cut-out portion 46 extending from each slot 44 that is situated directly behind the leg 36 of the plunger guide 32. Accordingly, close tolerances can be accomplished during the manufacture of the plunger guide 32 in order to ensure proper reciprocation of the plunger 30 within the guide 32. Both the plunger guide 32 and the nose 20 require close tolerances. The lugs 40, 42 and the two lugs 41 and 43 on vertical leg 36 of the plunger guide 32 in conjunction with configuration of the nose 20, allow close control of the dimension "x" of the channel within which the plunger 30 reciprocates with minimum parts.

In addition, the leading edge 45 of the leg 38 of guide 32 is curled downward at 47 leaving extensions 49 and 51. Once assembled, the engagement of the lugs 40 and 42 within the slots 44 and the position of the extensions 49 and 51 with the nose portion 20 serve to control the dimension "y" of the blade drive path. Whereas the flanges 41 and 43 bearing against the flanges 21 of the nose portion allow better control of the dimension "x" for the plunger guide 30.

Returning to FIGS. 1–3, the spring 28 is secured to the plunger 30 at one end and at the other end is coiled around an extension 46 of an adjusting screw 48. The adjusting screw 48 includes threads 50 that are threaded within a bushing 52 secured within the frame 12. The adjusting screw 48 may be screwed within the bushing 52 to adjust the amount of compression applied to the spring 28 thus adjusting the driving force developed by the spring 28. Consequently, the power developed by the tacker 10 may be varied through the employment of the adjusting screw 48.

To move the plunger 30 against the spring 48 and to drive a fastener 26 into a workpiece, a handle 54 and a trip pawl 56 pivotally mounted to the handle by a pivot pin 58 are included. The trip pawl 56 is biased by a pawl spring 60 toward the nose 20 and the plunger 30. In addition, the handle 54 is biased upwardly away from the grip portion 16 by a handle spring 62 that is secured to the frame 12 by a pin 63. During non-use, the handle 54 may be held in a position adjacent the grip portion 16 by a retainer or bail 64 that is pivotally secured to the grip portion 16. The bail 64 may be pivoted from the phantom position illustrated in FIG. 1 to a position extending over the end of the handle 54 as illustrated by solid lines in FIG. 1, thus holding the handle 54 against the handle spring 62 in a position adjacent the grip 16.

Once the handle 54 is released from the captured position illustrated in solid lines in FIG. 1 to the released position illustrated in phantom lines in FIG. 1, the trip pawl 56 is biased by the pawl spring 60 into a slot 66 fabricated within the plunger 30. The trip pawl 56 engages the upper edge of the slot 66 and mechanically couples the handle 54 to the plunger 30. Accordingly, the handle 54 may be gripped in the palm of the hand of the user with the fingers of the user extending through the aperture 18. Squeezing the handle 54 causes it to move downwardly to the general position illustrated in solid lines in FIG. 1. As this occurs, the plunger 30 is elevated within the plunger guide 32 under the influence of the raising pawl 56 (FIG. 2). As the handle 54 approaches engagement with the grip portion 16, the trip pawl 56 moves out of engagement with the upper surface of the aperture 66 releasing the plunger 30 and allowing the spring 28 to drive the driver 24 into engagement with a staple 26.

To understand the positioning of the staples 26 within the channel 22 such that the forward staple 26 is positioned within a drive track 68 defined adjacent the nose portion 20, reference is made to FIGS. 2 and 3. Illustrated in FIG. 2 is a pusher assembly generally designated by the reference numeral 70. Assembly 70 includes a U-shaped pusher 72 slideably secured to a pusher arm 74. The pusher 72 is approximately the same configuration and dimension as the staples 26 such that it may engage the end staple and push against the end staple 26 to move the staples 26 toward the drive track 68.

A stick of staples may be inserted in a magazine defined in the channel 22 in a manner well known in the art. To assist in moving the staples 26 toward the drive track 68, the rod 74 includes a spring 76 coiled thereabout. The spring 76 is secured to the pusher 72 and resiliently biases it toward the drive track 68.

Once the pusher assembly 70 is completely inserted, a latch 78 secured to the pusher rod 74 is latched to the frame 12 by flange 80 that is inserted into an aperture 82 defined within the grip portion 16.

Figure 6:
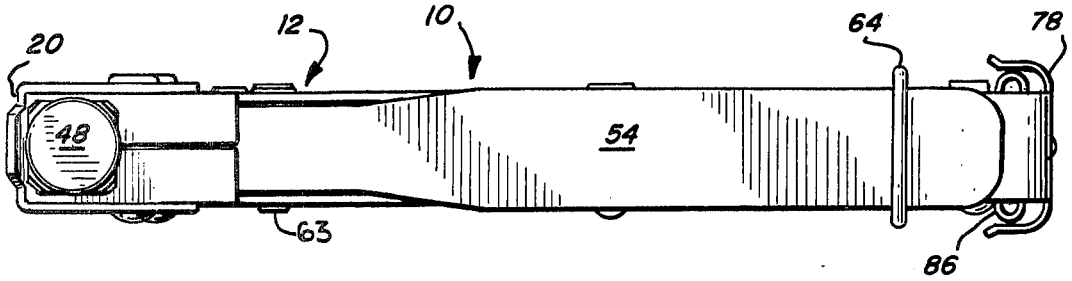
FIG. 6 is a top, elevational view of the tacker of the present invention.

Reciprocally mounted within the channel 22 is a magazine or channel member 84 that includes a flange portion 86 (FIGS. 3 and 6) at the end thereof. By gripping the flange portion 86, the magazine member 84 may be moved within the channel 22. The member 84 may be square and of a dimension such that fasteners 26 upon being introduced into the channel 22 may be moved on the member 84 along its length to the forward end 88 by the pusher 72. The forward end 88 of the channel member 84 is adjacent to the nose 20 and defines the drive track 68 when the member 84 is fully inserted in the channel 22.

The magazine member 84 includes a pair of flanges 89 that extend through a corresponding slot 91 in the frame 12. The flanges 89 slide within the slots 91 upon longitudinal movement of the member 84 within the channel 22 and serve as guides and limits to extent of withdrawal and insertion of the member 84 within the channel 22.

An operator of the tacker 10 may remove the pusher assembly 70 by removing the flange 80 from the aperture 82 and removing the entire assembly 70. Thereafter, the operator may grip the flange 86 and slide the member 84 within the channel 22 away from the drive track 68 exposing the area around the drive track 68 a sufficient amount such that the operator of the tacker 10 may insert a tool or a finger to remove any jammed staples 26. In order to maintain the magazine member 84 in the operative position with the forward end 88 adjacent the drive track 68, an off-center or bistable spring 90 is mounted within the frame 12. One end 91 of spring 90 is secured in an aperture 92 defined within the frame 12 so that the end 91 is secured to the tacker 10. The second end 94 of the bistable spring 90 is secured to a flange 96 defined on the channel member 84.

The spring 90 includes a first stable position illustrated in FIG. 2 wherein the spring 90 imparts a biasing force to the channel member 84 tending to bias the forward end 88 toward the drive track 68. The off-center or bistable spring 90 also includes a second stable position illustrated in FIG. 3. This second stable position of the spring 90 is attained by the operator gripping the flanges 86 and sliding the magazine member 84 backwardly within the channel 22 against the biasing force of the spring 90 until the spring 90 snaps into its second stable position. In the second position the spring 90 biases the member member 84 to a position away from the drive track 68. In this position, the operator may insert his finger or a tool to remove any jammed staples. The spring 90 may be returned to its first position illustrated in FIG. 2 by pushing on the magazine member 84.

While only a single embodiment of the present invention has been shown, it will be understood that various changes and modifications may occur to those skilled in the art and it is contemplated by the appended claims to cover all such changes and modifications as fall within the true spirit and scope of the present invention.

I claim:

1. A compact tacker for driving fasteners into a workpiece comprising:

a body defining a nose and a handle portion, said nose including a plunger guide;

a plunger mounted within said plunger guide and a driver for driving said fasteners secured to said plunger, means for powering said plunger through a drive stroke to drive said fasteners into said workpiece;

a fastener magazine slideably mounted on said housing, said magazine having a forward end spaced from said nose and defining a drive track for said driver therebetween; and bistable biasing means for biasing said magazine toward said nose in a first bistable position and for biasing said magazine a spaced distance from said nose in a second stable position.

2. The tacker claimed in claim 1 wherein said biasing means comprises an overcenter spring secured to said housing and to said magazine.

3. The tacker claimed in claim 1 further comprising a one-piece plunger guide mounted in said nose.

4. The tacker claimed in claim 3 wherein said nose includes a transverse slot, said plunger guide includes at least one lug positioned within said slot thereby defining the position of said guide relative to said nose and said drive track.

5. A compact, hand-held tacker for driving fasteners into a workpiece comprising:

a body including a handle and a nose portion;

a drive track defined in said nose portion and a driver assembly reciprocally mounted within said drive track;

means for driving said driver assembly;

a magazine assembly slideably mounted on said body, said magazine assembly including a forward end being adjacent said nose portion with a portion of said drive track defined between said nose portion and said forward end of said magazine assembly in a first position of said magazine assembly and said forward end being spaced from said drive track to allow access thereto in a second position of said magazine assembly; and a bistable resilient member secured to said body and said magazine assembly, said resilient member biasing said magazine assembly to said first position in a first stable position and biasing said magazine assembly to said second position in a second stable position.

6. The tacker set forth in claim 5 wherein said bistable resilient member comprises an off-center spring.

7. The tacker set forth in claim 5 wherein said driver assembly includes a one-piece plunger guide secured to said nose portion, a plunger reciprocally mounted in said plunger guide, and a driver blade secured to said plunger and in said drive track.

8. The tacker set forth in claim 7 further comprising a handle pivotally mounted on said body, and trip pawl means secured to said handle and adapted to engage said plunger and move said plunger to a driving position.

9. A device for driving a fastener into a workpiece comprising:

a frame defining a nose portion and a channel;

a drive track defined in said nose portion;

a driver reciprocally mounted in said drive track;

means for driving said driver including a compression spring and a handle selectively, mechanically coupled to said spring to compress said spring upon actuation;

a fastener magazine slideably mounted in said channel; and a bistable biasing member secured to said frame and to said magazine including a first stable position biasing said magazine toward said drive track and a second stable position biasing said magazine away from said drive track to define an opening around said drive track.

10. The device claimed in claim 9 wherein said biasing member comprises an off-center spring.

11. The device claimed in claim 9 further including a plunger reciprocally mounted in said nose portion and coupled to said driver and said compression spring, and a one-piece plunger guide mounted in said nose portion in which said plunger is slideably mounted, said nose portion including first and second slots and said plunger guide including first and second flanges positioned in said first and second slots, respectively.

12. The device claimed in claim 11 wherein said plunger includes a slot and said device further includes a trip pawl pivotally coupled to said handle and moveable into engagement with said slot upon actuation of said handle to elevate said plunger and compress said compression spring.

13. A device for driving a fastener into a workpiece comprising:

a frame defining a handle and a nose portion;

a drive track defined within said frame adjacent said nose portion;

a driver reciprocally mounted in said drive track;

means for driving said driver through a driven stroke to drive said fastener into said workpiece; and access means for selectively providing access to said drive path to remove jammed fasteners therefrom, said access means including a member adjacent said drive track in a first position, said member slidably mounted on said frame and slidable to a second position spaced from said drive track to allow access to said drive track.

14. The device claimed in claim 13 further comprising a bistable biasing element secured to said member and to said frame, said biasing element in a first stable position, biasing said member in said first position toward said drive track and said biasing element in a second stable position biasing said member in said second position away from said drive track.

15. The device claimed in claim 13 further comprising a plunger reciprocally mounted in said nose portion and secured to said driver, and a one-piece plunger guide secured to said frame.

16. The device claimed in claim 15 wherein said plunger guide includes first and second legs and at least one flange defined on said first leg, said frame including at least one slot, said flange being mounted in said slot.

* * * * *